US005791122A

United States Patent [19]

Tobin et al.

[11] Patent Number: 5,791,122

[45] Date of Patent: Aug. 11, 1998

[54] SYSTEM AND METHOD FOR CHARGING CANISTERS WITH A HIGH PRESSURE GAS

[75] Inventors: Brian P. Tobin, Bay City; Douglas M. Leonard, Auburn, both of Mich.

[73] Assignee: RWC, Inc., Bay City, Mich.

[21] Appl. No.: 664,569

[22] Filed: Jun. 17, 1996

[51] Int. Cl.[6] ..... B65B 31/00

[52] U.S. Cl. ..... 53/403; 141/383; 141/232; 141/164; 53/83; 53/88

[58] Field of Search ..... 53/403, 404, 81, 53/83, 88, 89, 94, 97, 101, 110; 141/383, 232, 177, 164

[56] References Cited

U.S. PATENT DOCUMENTS

| | | | |
|---|---|---|---|
| 3,977,151 | 8/1976 | Reever et al. | 53/88 |
| 4,494,363 | 1/1985 | Rica et al. | 53/88 |
| 5,352,860 | 10/1994 | Richardson | 53/403 |
| 5,495,699 | 3/1996 | Buckley, Jr. | 53/81 |

*Primary Examiner*—Daniel Moon
*Assistant Examiner*—John Paradiso
*Attorney, Agent, or Firm*—Lalos 7 Keegan

[57] ABSTRACT

A system for charging a metallic canister having a filler opening therein with a gas under pressure and then sealing the opening to provide a closed, pressurized canister generally consisting of means for retaining the canister in a predetermined orientation, a sealing member having a guide passageway therein displaceable between an extended position in sealing engagement with a canister disposed in the predetermined orientation, with the guide passageway therein communicating with the filler opening of the canister, and a retracted position out of sealing engagement with the canister, a first means for applying a gas under pressure to a first side of the sealing member to urge the sealing member into into its retracted position, second means for supplying a gas under pressure to an opposite side of the sealing member to urge the sealing member into its extended position in sealing engagement with the canister, third means for supplying a gas under a third pressure to the guide passageway of the sealing member when the sealing member is in its extended position to pressurize the canister, means for welding the filler opening of the canister closed when the sealing member is in its extended position in sealing engagement with the canister and while operating the third gas supplying means and maintaining the pressure in the canister at the third pressure, and means for sequentially deactivating the third gas supplying means, deactivating the second gas supplying means and activating the first gas supplying means to return the sealing member to its retracted position.

42 Claims, 3 Drawing Sheets

SYSTEM AND METHOD FOR CHARGING CANISTERS WITH A HIGH PRESSURE GAS

This invention relates to the manufacture of components for inflatable restraining systems used in automotive vehicles, and more particularly to a system and method for charging metallic canisters used in inflatable restraining systems with a gas under high pressures and sealing such canisters upon pressurization.

BACKGROUND OF THE INVENTION

Inflatable restraining systems used in automotive vehicles typically include an inflatable bag installed within the passenger compartment of a vehicle and adapted to inflate to provide a cushioning barrier between the vehicle structure and a passenger seated within the vehicle, a metallic canister containing a supply of an inert gas under pressure which is adapted to be released to inflate the bag to provide such barrier, and sensors positioned at locations about the periphery of the vehicle for sensing an impact during a collision of the vehicle and generating a signal to cause the canister to rupture and release its supply of gas for inflating the bag. Generally, such canisters consist of a small metallic container having a detonator mounted on one end thereof which may be caused to detonate by a signal generated by a sensor to rupture the canister wall and allow the release of gas to inflate the bag.

In the manufacture of such canisters, the body of the canister is first formed of a suitable metallic material, an opening is formed in the body wall, a gas is injected through the wall opening to pressurize the body and then the wall opening is welded closed to seal the pressurized gas within the canister. The charging pressures of such canisters typically are in the range of 3,500 to 10,500 psi. In some applications, the canister initially may be pressurized to an elevated pressure within such range of pressures to test the structural integrity of the canister, and then the pressure would be reduced to a lower, operating pressure within such range.

Because of the magnitude of the pressures used in filling or testing and filling such canisters, a highly effective and consistent seal is required between the gas injecting device and the canister during the filling and sealing of the canister. The sealing force applied to the gas injecting device must not only provide an effective and consistent seal between the device and the canister but must remain stable during variations in the pressure of the gas injected into the canister. Variations in pressure occur when an elevated pressure is first applied for testing purposes and is then reduced in magnitudes of thousands of pounds down to the operating pressures of the canisters. Such sealing force must be sufficient to accommodate gas pressures in the upper region of such range of pressures and greater variances in the magnitude of such pressures within such range. It further must be controllable to permit a sufficient force to be applied to form an effective seal without causing structural damage to the canister. The present invention provides a system and method of charging such a canister with a gas under pressure and varying the magnitude of such pressure while providing an effective and consistent seal between the gas injecting device and the canister being pressurized.

Accordingly, it is the principal object of the present invention to provide a system for pressurizing and sealing a canister of the type utilized in inflatable restraining systems for automotive vehicles.

Another object of the present invention is to provide an improved system for pressurizing and sealing a canister of the type used in inflatable restraining systems, at a pressure in the range of 3,500 to 10,500 psi.

A further object of the present invention is to provide an improved system for pressurizing a canister of the type used in inflatable restraining systems wherein an effective and consistent seal may be formed between the gas injecting device and such canister.

A still further object of the present invention is to provide an improved system for pressurizing a canister of the type used in inflatable restraining systems wherein an effective and consistent seal is formed between the gas injecting device and such canister, providing for the application of a force sufficient to provide a suitable seal without causing to structural damage to the canister wall.

Another object of the present invention is to provide a system for pressurizing and sealing a canister of the type used in inflatable restraining systems, allowing such canister to be pressurized to an elevated pressure in the range of 3,500 to 10,500 psi for the purpose of testing the structural integrity of the canister, and then allowing a reduction of such pressure to a lower operating pressure and sealing the canister while maintaining an effective and consistent seal between the gas injecting device and the canister.

A further object of the present invention is to provide an improved assembly for injecting a gas under pressure into a canister of the type used in inflatable restraining systems for automotive vehicles.

A still further object of the present invention is to provide an improved assembly for charging a metallic cylinder of the type used in inflatable restraining systems of vehicles, with a gas under pressure, in which a seal may be provided between a gas injecting device and such a canister.

Another object of the present invention is to provide an improved method for pressurizing and sealing a canister of the type utilized in inflatable restraining systems for automotive vehicles.

Other objects and advantages of the present invention will become more apparent to those persons having ordinary skill in the art to which the present invention pertains from the accompanying drawings taken in conjunction with the following description.

DESCRIPTION OF THE PREFERRED EMBODIMENT OF THE INVENTION

Figure 1:
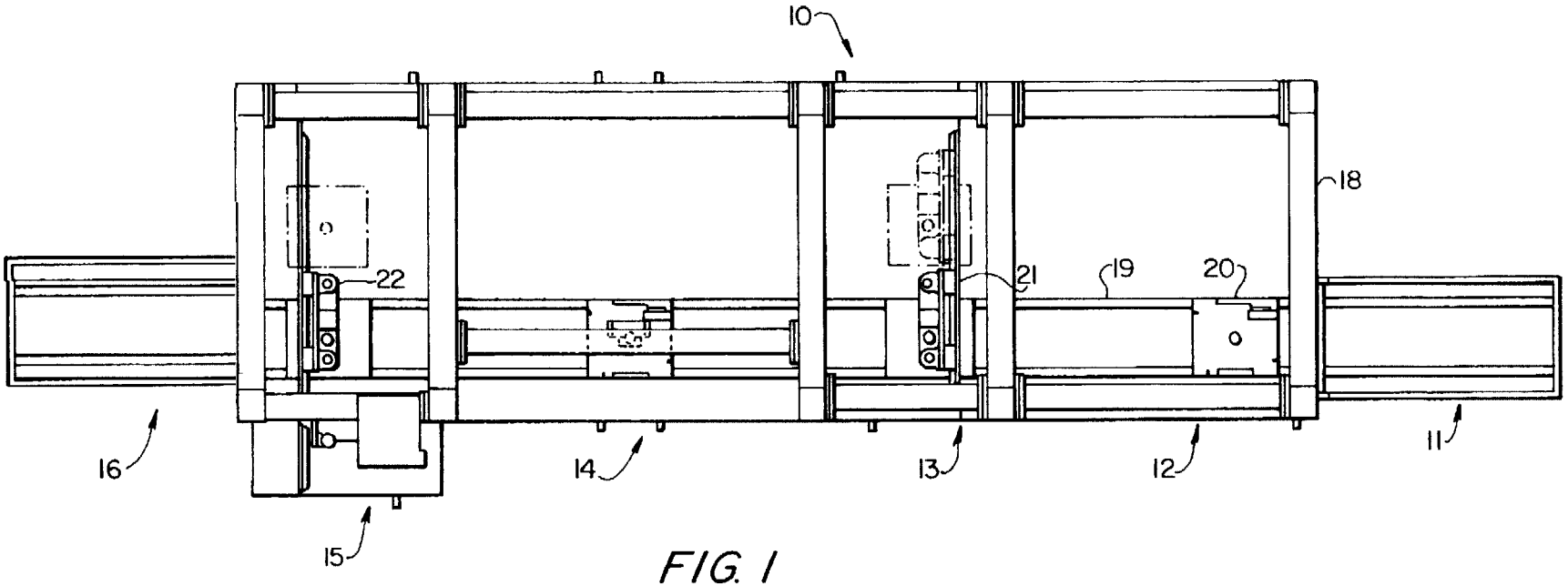
FIG. 1 is a top plan view of an embodiment of the present invention which provides for mounting an empty inflatable bag canister on a retaining fixture in a selected orientation, forming a gas filling opening in the canister, charging the canister with a gas under high pressure through the formed opening, and closing and sealing the opening.

Referring to the drawings, there is illustrated an embodiment of the invention. The embodiment consists of an apparatus 10 including a canister loading station 11, a filler hole forming station 12, a preweighing station 13, a gas charging and sealing station 14, a post weighing station 15 and an unloading station 16, and a gas supply system 17. The apparatus is provided with a main frame 18 on which there is mounted a conveyor 19 for advancing a canister supporting pallet 20 sequentially from canister loading station 11 through unloading station 16. Each of such pallets includes a canister retaining fixture adapted to position the canister in a predetermined orientation to allow for the formation of a filler opening in the canister at the hole forming station and subsequent charging of a gas under pressure and the sealing of such opening at the gas charging and sealing station.

Mounted on the main frame at station 12 is a hole piercing assembly 12*a*. Such assembly is positioned on the main frame relative to the conveyor so that when a pallet carrying a canister disposed in a selected orientation is positioned at station 12, the piercing tool of the assembly will be vertically aligned with the portion of a canister to be punctured. Mounted on the main frame at station 13 is a transfer mechanism 21 which is adapted to laterally displace a pallet 20 positioned at station 13, weigh the empty, pierced canister and transfer it laterally back onto the conveyor for advancement to station 14. A gas charging and sealing assembly 14*a* is mounted on the main frame at station 14 which functions to charge a canister supported on a pallet positioned at station 14 with a gas under pressure, and seal the gas filling hole in the canister in a manner to be described.

Disposed between stations 14 and 15 or at station 15 is a means for detecting a defective canister. Also mounted at station 15 is a mechanism 15*a* for post weighing a filled and sealed canister positioned at station 15, and a defective canister processing assembly. Upon detection of a canister with a defective filling hole closure or an underweight or overweight canister positioned at station 15, the defective canister processing assembly will be operated to drill a relief hole in the canister and allow the release of gas from the canister. The pallet supporting canisters at station 15 are then transferred laterally by a mechanism 22 from where they are advanced to station 16 for unloading.

Preferably, conveyor 19 is an endless conveyor on which pallets 20 are spaced apart the distances between successive stations on the apparatus. Canisters loaded onto fixtures supported on pallets at the loading station are incrementally advanced by the conveyor sequentially to station 12 where the gas filling hole is formed, station 13 where the canister is preweighed, station 14 where the canister is charged with a gas under pressure and the gas filling hole in the canister is welded closed, station 15 where the canister is postweighed and defective canisters are drilled to release the gas therein and station 16 where the canister is removed.

In circumstances where the filler holes in the canisters may have been preformed in a prior operation of the process, the apparatus as described may be modified so that the mechanism or fixture provided at station 12 may be arranged merely to properly orient the canister in the support fixture so that upon advancing the canister to station 14, the filler hole will be vertically aligned with the gas charging opening and weld electrode of a gas charging and sealing assembly as hereinafter described.

Figure 2:
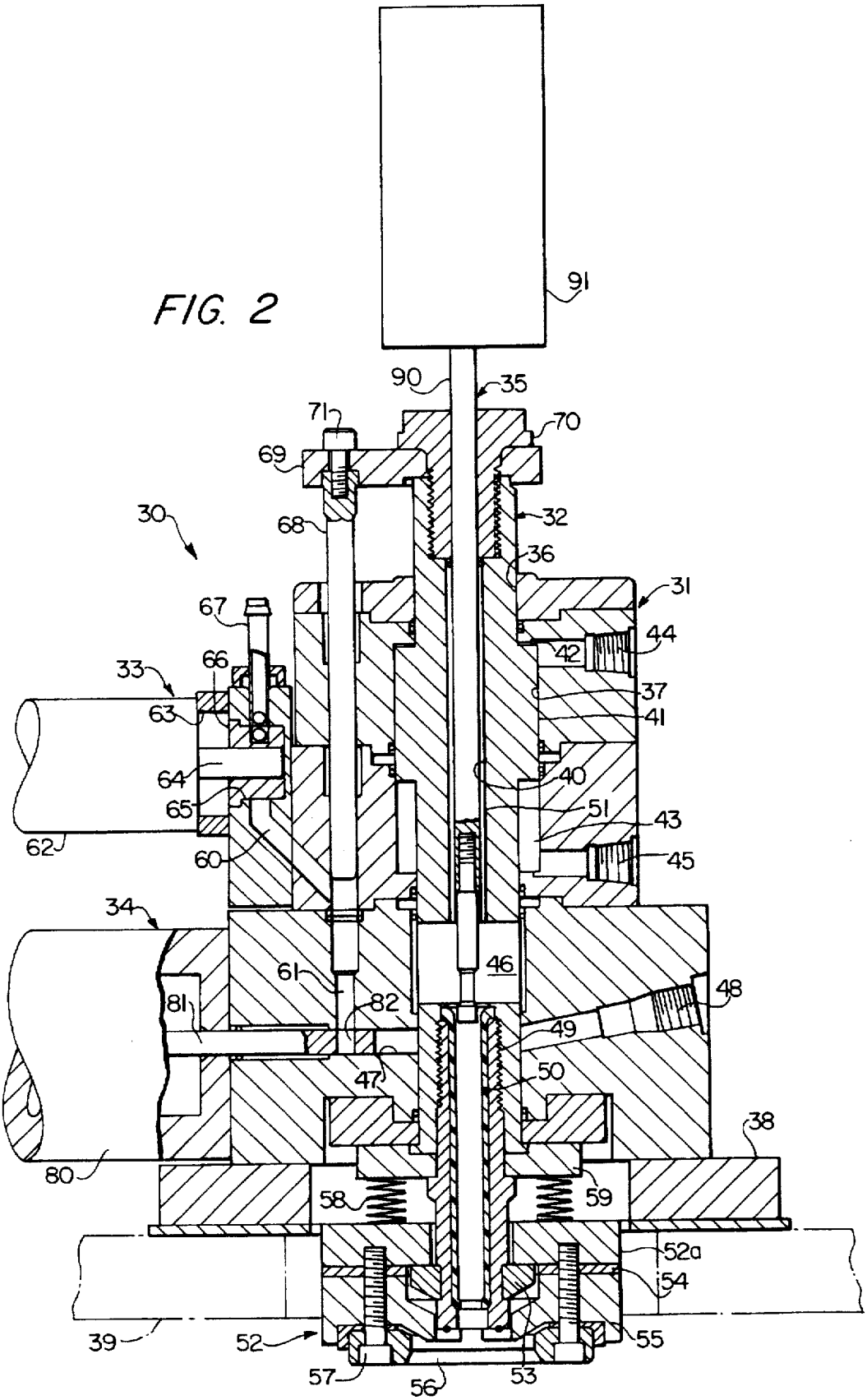
FIG. 2 is an enlarged, vertical cross sectional view of a welding head assembly utilized in the system shown in FIG. 2 for sequentially filling the canister with a gas under pressure through a gas filling opening in the canister and then sealing such opening.

Referring to FIG. 2, there is shown a welding head assembly 30 which is mounted on the main frame of the apparatus shown in FIG. 1 for charging a canister positioned at station 14 with a gas under pressure through a filler opening in the canister formed at station 12, and then sealing such filler opening to provide a closed, pressurized canister. The assembly generally includes a housing 31, a sealing member 32, a welding ball feed mechanism 33, a welding ball transfer mechanism 34 and a welding rod assembly 35. The housing is formed of a number of annular steel plates bolted together to provide a longitudinal bore 36 therethrough having an enlarged section 37 provided with a cylindrical side wall and opposed, annular end walls. The housing is adapted to be seated on an annular member 38 mounted on a crosspiece member 39 of main frame 18.

Sealing member 32 is disposed in longitudinal bore 36 and is adapted to be displaced therein between a retracted position as shown in FIG. 2 and an extended position. The member is substantially tubular in configuration, providing an axially disposed guide passageway 40. It further is provided with an annular section 41 received within enlarged section 37 of opening 36. The sealing member with annular section 41 cooperates with the cylindrical side wall and annular end walls of enlarged section 37 to provide a pair of variable volume chambers 42 and 43. Communicating with chamber 42 is a fluid passageway 44. Similarly provided in housing 31 is a fluid passageway 45 which communicates with chamber 43. Suitable seals are provided between displaceable sealing member 32 and housing 31. It will be appreciated that by supplying fluid under pressure to one of chambers 42 and 43 while venting the other, annular section 41 will function as a piston to displace the sealing member between the retracted and extended positions in the conventional manner.

Sealing member 32 further is provided with a transversely disposed access opening 46 at a point intermediate annular section 41 and an end portion thereof. Access opening 46 communicates with guide passageway 40, and is adapted to be displaced between a first positioned as shown in FIG. 2 when the sealing member is in the retracted position, and a second position communicating with a ball transfer passageway 47 and a gas supply passageway 48 in the housing when the sealing member is in the extended position. The outer end of sealing member 32 is provided with an internally threaded opening into which a tip section 49 is threaded. The tip section is provided with a longitudinal passageway aligned with guide passageway 40, which is provided with an electrical insulating lining 50. Guide passageway 40 of the sealing member similarly is provided with an electrical insulating lining 51.

Preferably access opening 46 is located at a point as close as possible to the dispensing end of the sealing member with communicable passageways 47 and 48 similarly being located at a lower end of the housing to minimize the length of the weld electrode. Furthermore, although only a single access opening is provided in the embodiment shown in the drawings communicable with both passageways 47 and 48, it is contemplated within the scope of the invention to provide two separate access openings, one communicating with passageway 40 and communicable with passageway 47 and the other communicating with passageway 40 and communicable with passageway 48, when the sealing member is in the extended position. Furthermore, such two access openings can be longitudinally spaced along the length of the sealing member.

Mounted on a lower end of tip section 49 and adapted to engage a portion of a canister disposed about the periphery of the filler opening thereof, when the sealing member is in the extended position, is an electrical grounding assembly 52. The assembly includes an annular metallic member 52(*a*) seated on an annular member 53 rigidly secured to and displaceable with end of tip section 49, an annular spacer 54 mounted on the underside of member 52(*a*), an annular member 55 mounted on the spacer, and an annular, canister engaging member 56, secured together by a set of bolts 57. Annular member 55 is provided with a portion having an inner diameter greater than the outer diameter of annular member 53 to permit longitudinal displacement of member 55 relative to member 53, and an inwardly projecting portion having a surface engageable with annular member 53 to limit the axial displacement between the grounding assembly and the sealing member. Annular member 52 is urged into seating engagement with member 53 by means of a set of circumferentially spaced springs 58 interposed between an annular member 59 rigidly secured to and displaceable with the sealing member, and annular member 52. It will be appreciated that when the sealing member is displaced to its extended position with the end section thereof engaging a canister, canister engaging member 56 will engage the canister about an outer perimeter of the filler opening therein in advance of tip section 49 engaging the canister about an inner perimeter of the filler opening, to provide a suitable mechanical and electrical contact with the canister. Such engagement is facilitated by springs 58 which function to urge and maintain engaging member 56 in positive mechanical and electrical contact with the canister.

The function of welding ball feed mechanism 33 is to feed a welding ball to the ball transfer mechanism for injection through access passageway 41 and guide passageway 40 in the sealing member, to drop and be deposited on a canister across the filler opening therein. The mechanism operates to meter a single ball at a time through passageways 60 and 61 in the housing to passageway 47 where it is transferred into the guide passageway of the sealing member through access passageway 46 in the sealing member by transfer mechanism 34. The feed mechanism includes a rotary actuator 62 having an end bracket 63 rigidly secured to housing 31 and a shaft 64 extending into a recess in the housing having a cylindrical side wall. Mounted on the end of shaft 64 and disposed within recess 65 is an annular feed valve 66 having a substantially radially disposed pocket in the outer circular surface thereof relative to the axis of shaft 64. In a first position as shown in FIG. 2, the ball receiving opening in feed valve 66 is adapted to register with and receive a single welding ball from a feed chute 67. The chute is connected to a continuous supply of welding balls which are guided through a flexible tube connected to the feed chute. In a second position angularly displaced 180° from the first position, the ball receiving opening is adapted to register with an inlet of passageway 60. It will be appreciated that with rotary feed valve 66 being in the position as shown in FIG. 2, a ball in the feed chute will be caused to be received in the ball receiving pocket of rotary feed valve 66 and upon rotating shaft 64 180°, such ball will be fed to passageway 60 from where it will be caused, if unobstructed, to be delivered to passageway 47.

The passage of a ball from passageway 60 to passageway 47 is controlled by a sliding gate 68 displaceable in passageway 61 between a retracted, unobstructing position as shown in FIG. 2, and an extended, obstructing position, blocking the passage of a ball from passageway 60 into passageway 61. The displacement of the sliding gate between its retracted and extended positions is actuated by and thereby coordinated with the displacement of the sealing member by means of a rigid connection between the outer end portions of such members. The connection is provided by an arm member 69 which is secured to the outer end of the sealing member by a threaded member 70 and to the sliding gate by a bolt 71. In addition, such connection prevents any rotary motion of the sealing member which otherwise could result in misalignment of access opening 46 with passageways 47 and 48 when the sealing member is in its extended position in sealing engagement with a canister. With such a connection, it will be appreciated that when the sealing member is in its retracted position as shown in FIG. 2, sliding gate 68 similarly will be in a retracted position with the opening between passageways 60 and 61 being unobstructed to permit a welding ball to pass therethrough into passageway 47.

When the sliding gate is in its extended position, a suitable seal is provided between the sliding gate and housing 31, at a point between passageways 60 and 47, to prevent a loss of gas under pressure injected through passageway 48.

Ball transfer mechanism 34 includes a pneumatic cylinder assembly 80 mounted on housing 31, having a ball transfer slide 81 received within ball transfer passageway 47 and displaceable therein between a retracted position as shown in FIG. 2 and an extended position. Ball transfer slide 81 includes a slot 82 therein which is adapted to register with passageway 61 when the slide is in the retracted position. The slide is adapted to displace to its extended position only upon the displacement of the sealing member into its extended position with access opening 46 registered with opening 47 to permit the transfer slide to be received within access opening 46 of the sealing member and permit slot 82 to be aligned with guide passageway 40 in the sealing member to further permit a welding ball to drop into the guide passageway of the sealing member.

A suitable seal also is provided between transfer slide 81 and housing 31 at a point between the juncture of passageways 61 and 47 and an outer end of passageway 47, to further prevent the loss of gas under pressure injected through passageway 48.

Welding rod assembly 35 includes a welding rod 90 extending through guide passageway 40 and being displaceable between a retracted position as shown in FIG. 2 and an extended position engaging a welding ball deposited on a canister across the filler opening therein. The upper end of the welding rod is secured to a support member 91 which is operatively connected to a pneumatic cylinder assembly for displacing the welding rod between its retracted and extended positions. The welding rod further is electrically connected to a secondary lead of a welding transformer with the electrical grounding assembly 52 connected to the other secondary lead of the transformer so that upon the sealing member being disposed in its extended position with canister engaging member 56 in positive mechanical and electrical engagement with a canister, the welding rod being in its extended position in positive mechanical and electrical contact with a welding ball deposited on the canister across the filler opening thereof, and alternating current is supplied, the welding ball will be caused to fuse and thus flow and seal the filter opening closed.

A suitable seal also is provided between welding rod 90 and sealing member 32, again to prevent a loss of gas under pressure injected through passageway 48 when the sealing member is in the extended position.

Gas supply system 17 functions to provide gas under pressure to normally urge sealing member 32 in its retracted position out of engagement with a canister to be pressurized, advance the sealing member into its extended position in sealing engagement with a canister, with the guide passageway therein in communication with the filler opening in the canister and transverse access opening 46 thereof in communication with ball transfer passageway 47 and fluid passageway 48, and further to supply a gas under pressure through passageways 48, 46 and 40 to pressurize the canister through the filler opening therein when the sealing member is in its extended position providing a fluid tight seal between the sealing member and the canister. The system includes a main fluid supply line 100 provided with a pair of branch lines 101 and 102. Main fluid line 100 is connected to a source of fluid under pressure and includes an accumulator 103 and a main shut-off valve 104. Branch line 101 is connected to fluid passageway 48 and includes a pressure regulator 105, a relief valve 106 and a pneumatically actuated valve 107. Connected to branch line 101 between valve 107 and fluid passageway 48 is a branch line 108 provided with a pneumatically actuated valve 109. Valve 107 is normally in the closed position and valve 109 normally is in the open position. Such valves are operated by an electrically operated solenoid valves 110 and 110*a*.

Branch line 102 is connected to fluid passageway 44 of assembly 30 and is provided with a pressure regulator 111 and a pneumatically actuated valve 112. Interconnecting fluid line 102 at a point between pressure regulator 111 and valve 112 is a branch line 113 connected to fluid passageway 45 of assembly 30. Such branch line includes a pressure regulator 114 and a pneumatically actuated valve 115. Valve 112 is normally positioned to vent fluid passageway 44 and valve 115 is normally in the opened position to provide fluid under pressure to fluid passageway 45 of assembly 30. Valves 112 and 115 are operated by electrically operated solenoid valves 116 and 116*a*.

A conventional programmable controller is used to operate solenoid valves 110, 110*a*, 116 and 116*a* and solenoid valves controlling the operations of rotary actuator 62, cylinder assembly 80 and the cylinder assembly for displacing the welding rod assembly, and to energize the welding rod circuit, in a proper sequence to charge and seal a canister in a manner as hereinafter described.

Operation

Figure 3:
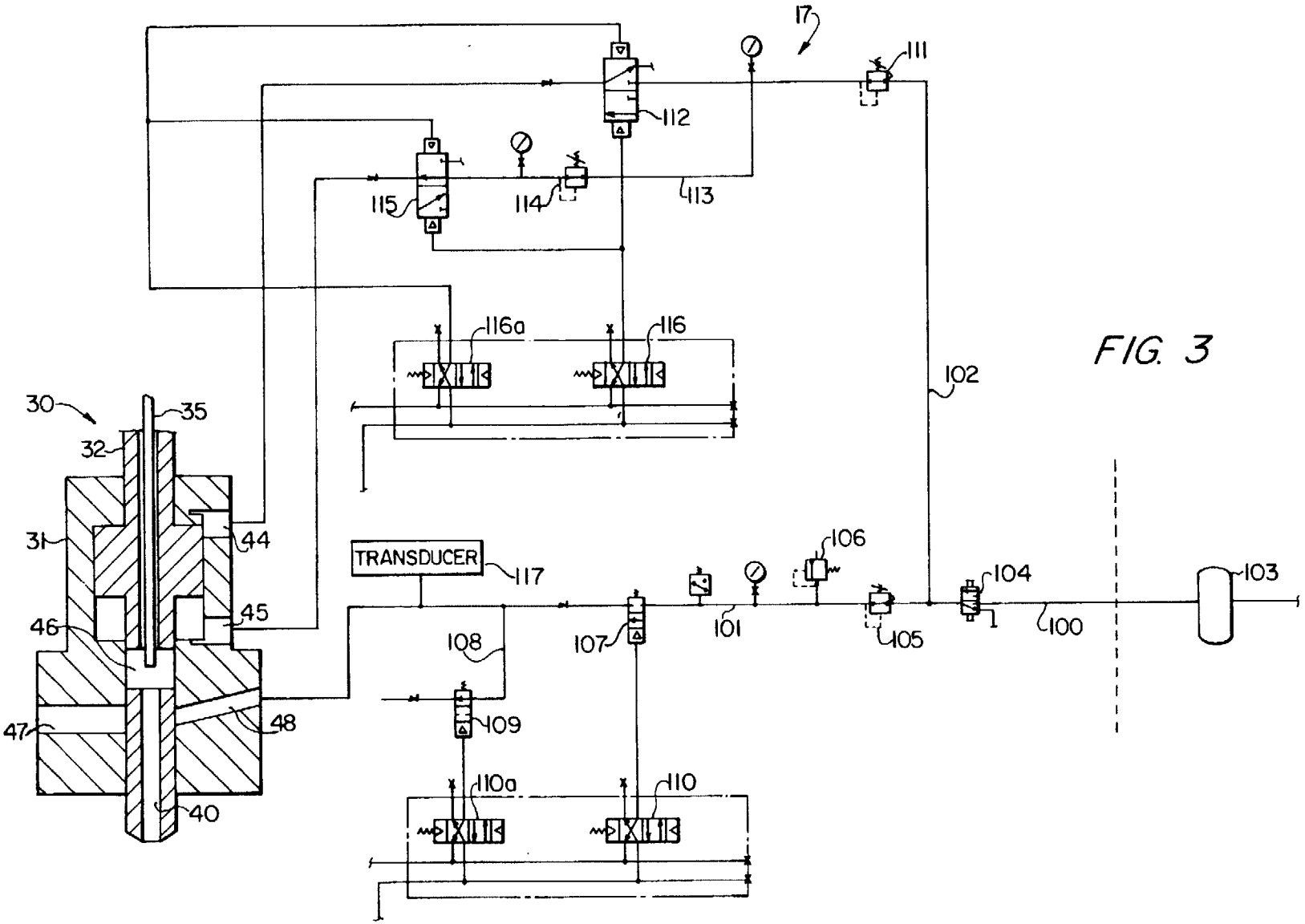
FIG. 3 is a schematic-diagrammatic view of the system and assembly shown in FIGS. 1 and 2.

With a main line pressure of 10,000 psi, pressure regulator 105 set at 4,500 psi, pressure regulator 111 set at 5,000 psi, pressure regulator 114 set at 500 psi and the various valves being in the positions as shown in FIG. 3, gas under a pressure of 500 psi will be supplied to fluid passageway 45 of assembly 30 to cause the sealing member to be urged into its retracted position as shown in FIGS. 2 and 3. Upon a canister being positioned at station 14 with its filler opening aligned with the guide passageway of sealing member 32, the controller will operate solenoid valves 116 and 116*a* to shift valves 115 and 112 to vent fluid passageway 45 and supply a gas under 5,000 psi to fluid passageway 44 of assembly 30. Under such conditions, sealing member 32 will be displaced from its retracted to its extended position so that electrical ground assembly 52 will engage the canister about an outer perimeter of the filler hole therein to provide a positive mechanical and electrical contact, and, sequentially, tip section 49 of the sealing member will engage the canister about an inner perimeter of the filler hole therein in sealing engagement, with guide passageway 40 in the sealing member communicating with the interior of the canister through the filler opening. Upon the seal between the sealing member and canister having thus been formed, the controller next functions to operate valves 110 and 110*a* to open valve 107 and close valve 109. Under such condition, gas under a pressure of 4,500 psi will be supplied to fluid passageway 48 to pressurize the canister valve 107 is then closed. While maintaining such pressure, transfer mechanism 34 is operated to displace transfer slide 81 from its retracted position as shown in FIG. 2 to its extended position within access opening 46 of the sealing member, allowing a welding ball having been deposited in slot 82 of the transfer slide to drop through the lower end of guide passageway 40 and be deposited on the canister across the filler opening therein, in alignment with welding rod 90. With the welding ball thus positioned and the filling pressure maintained, the controller next functions to sequentially displace the welding rod from the retracted position as shown in FIG. 2 to an extended position in positive mechanical and electrical contact with the welding ball seated across the filler opening in the canister, and energize the welding circuit, causing the welding ball to fuse and close the filler opening in the pressurized canister. While the sealing member is in the extended position, sliding gate 68 similarly will be in an extended position blocking communication of ball passageway 60 with ball passageway 61. Under such circumstances, the controller will function to operate rotary actuator 62 causing the shaft to rotate 180° to transfer a ball in the recess of annular feed valve 66 to ball passageway 61 where it rolls up against extended sliding gate 68, postured to fall into and through ball passageway 61 and be received in slot 82 of the transfer slide when the transfer slide is in its retracted position and the sliding gate is next displaced to its retracted position.

Upon the passage of a predetermined interval of time to allow the fused ball to solidify and form a closure in the filter opening of the canister, the controller functions to operate valve 110*a* to open valve 109 to vent passageway 48. Once the charging assembly has been evacuated, the controller functions to again close valve 109 and the pressure in the charging assembly is sensed to determine whether there is any leakage through the fused seal. The controller then functions to shift valve 112 to vent fluid passageway 44 and close valve 115 to again pressurize fluid passageway 45 and correspondingly cause sealing member 32 to retract to the position as shown in FIGS. 2 and 3. The gas charging and sealing assembly is then positioned to begin a new cycle as the next canister is advanced into position.

Under circumstances where it is desired first to test the structural integrity of the canister prior to pressurizing it to its operating pressure, the same procedure may be followed except for setting pressure regulator 105 at a pressure greater than the desired fill pressure, in the order of perhaps 8,500 psi, to initially pressurize the canister at such elevated pressure and for then operating valves 110 and 110*a* to sequentially close valve 107 and bleed gas from the canister by opening valve 109 until the pressure in the canister is reduced to the operating pressure of 4,500 psi. To control such pressure reduction, a transducer 117 is provided to sense the pressure in the canister and cause the controller to close valve 109 when the desired operating pressure in the canister has been reached.

In addition to branch line 113 being used to cause a retraction of the sealing member, pressure regulator 114 may be set at different settings and valve 115 may be opened to supply gas under pressure to fluid passageway 14 while gas under pressure is supplied to fluid passageway 44 to provide a pressure differential across the sealing member. Under such circumstances, the force applied on the sealing member may be varied. With such capability, canisters formed of different materials or possibly having different wall thicknesses may be accommodated without causing structural damage to such canisters in forming the seal as described.

The settings of the pressure regulators may be set at any desired settings depending on the required filling pressures or the required testing and filling pressures. Preferably, the sealing pressure determined by pressure regulator 111 would be in the range of 2,000 to 5,000 psi and the testing and fill pressures determined by pressure regulator 105 would be in the range of 3,500 to 10,500 psi. The retract pressure determined by pressure regulator 114 can be set at any lower pressure such as 500 psi, sufficient to provide a sufficient force to retract the sealing member except when it may be desired to provide a differential pressure to more accurately control the sealing force of the sealing member as previously described.

To provide even greater flexibility in accommodating canisters having different size filler openings, the width or diameter and depth of the ball receiving pocket in annular feed valve 66 and the width of ball receiving slot 82 in the transfer slide are made sufficiently large to accommodate welding balls of different sizes.

By the use of independent sources of pressure for effecting the seal between the sealing member and the canister, and for pressurizing the canister, an effective and consistent seal is provided during the canister pressurization operation and particularly during the application of variable pressures as during the testing and filling procedure as previously described. In addition, the use of such separate sources of pressure permits the application of a differential pressure on the sealing member providing a greater flexibility in operation.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof as limited solely by the appended claims.

We claim:

1. A system for charging a metallic canister having a filler opening therein with a gas under pressure and then sealing said opening to provide a closed, pressurized canister comprising:

means for retaining said canister in a predetermined orientation;

means having a guide passageway therein displaceable between an extended position in sealing engagement with a canister disposed in said predetermined orientation, with said guide passageway therein communicating with said filler opening therein, and a retracted position out of sealing engagement with said canister;

first means for supplying a gas under a first pressure to a first side of said displaceable means to urge said displaceable means into said retracted position;

second means for supplying a gas under a second pressure to a second side of said displaceable means opposite said first side to urge said displaceable means into said extended position in sealing engagement with said canister;

third means for supplying a gas under a third pressure to said guide passageway of said displaceable means when said displaceable means is in said extended position to pressurize said canister;

means for sealing said filler opening of said canister when said displaceable means is in said extended position in sealing engagement with said canister and while operating said third gas supplying means and maintaining the pressure in said canister at said third pressure; and means for sequentially deactivating said third gas supplying means, deactivating said second gas supplying means and activating said first gas supplying means.

2. A system according to claim 1 wherein said first pressure consists of a pressure sufficient to displace said displaceable means from said extended to said retracted position.

3. A system according to claim 1 wherein said second pressure is in the range of 2,000 to 5,000 psi.

4. A system according to claim 1 wherein said third pressure is in the range of 3,500 to 10,500 psi.

5. A system according to claim 1 wherein said first gas supplying means includes a fluid line intercommunicating a source of fluid under pressure and said first side of said displaceable means, having a pressure regulator and a valve.

6. A system according to claim 1 wherein said second gas supplying means includes a fluid line intercommunicating a source of fluid under pressure and said second side of said displaceable means, having a pressure regulator and a valve.

7. A system according to claim 1 wherein said third gas supplying means includes a fluid line communicating with a source of fluid under pressure and communicable with said guide passageway, having a pressure regulator and a valve.

8. A system according to claim 1 wherein said third gas supplying means includes means for pressuring said canister at an elevated pressure to test the structural integrity of said canister and then reducing said elevated pressure to a lower pressure corresponding to a predetermined operating pressure of said canister.

9. A system according to claim 8 wherein said third gas supplying means includes a first fluid line communicating with a source of fluid under pressure and communicable with said guide passageway and having a pressure regulator set at said elevated pressure, and a second fluid line communicating with said first fluid line between said pressure regulator and said guide passageway and the atmosphere, having a selector valve therein.

10. A system according to claim 9 including means for operating said valve in said second fluid line after a predetermined interval to open said valve and vent said guide passageway and correspondingly said canister down to said operating pressure.

11. A system according to claim 1 wherein said sealing means includes means for transferring a fusible body onto said filler opening and means for fusing said fusible body transferred onto said opening to close said filler opening.

12. A system according to claim 11 wherein said fusible body transferring means includes means for injecting said fusible body into said guide passageway.

13. A system according to claim 11 wherein said fusing means includes a welding rod displaceable along said guide passageway into and out of contact with said fusible body disposed in said filler opening, and means for applying an electrical current to said welding rod.

14. A system according to claim 13 including electrically conductive means carried on said displaceable means, engageable with said canister when said displaceable means is in said extended position to provide an electrical ground for said welding rod.

15. A system according to claim 1 including a housing having an opening therethrough, said opening having an enlarged section, and wherein said displaceable means includes a first section having said guide passageway therein, displaceable along said housing opening, and a second section projecting into said enlarged section of said housing opening, cooperating with said housing and said first section of said displaceable means to provide a first variable volume chamber having said first side of said displaceable means forming a movable wall thereof, and a second variable volume chamber having said second side of said displaceable means forming a movable wall thereof, and wherein said first gas supplying means is connected to said first variable volume chamber and said second gas supplying means is connected to said second variable volume chamber.

16. A system according to claim 15 wherein said enlarged section of said housing opening includes a cylindrical side wall and opposed annular end walls, said first section of said displaceable means has a tubular configuration and said second section thereof has an annular configuration.

17. A system according to claim 15 wherein said displaceable means is provided with an access opening intercommunicating said guide passageway and said third gas supplying means when said displaceable means is in said extended position.

18. A system according to claim 15 wherein said displaceable means is provided with an access opening communicating with said guide passageway for receiving through said guide passageway and depositing a fusible body into said filler opening in said canister when said sealing means is in said extended position.

19. A system according to claim 15 wherein said displaceable means is provided with a transversely disposed access opening therein communicating with said guide passageway and communicable with said third gas supplying means and a passageway through which a fusible ball may be transferred into said guide passageway, when said displaceable means is in said extended position.

20. A system according to claim 19 wherein said access opening is provided in said first section of said displaceable means.

21. An assembly for charging a metallic canister having a filler opening therein with a gas under pressure and then sealing said filler opening to provide a closed, pressurized canister comprising:

support means having an opening therein;

means having a guide passageway therein and first and second sides, disposed in and displaceable along said opening in said support means between an extended position in sealing engagement with said canister, with said guide passageway communicating with said filler opening therein, and a retracted position out of engagement with said canister;

means for conveying a fluid under pressure to said first side of said displaceable means to urge said displaceable means into said retracted position out of engagement with said canister;

means for conveying a fluid under pressure to said second side of said displaceable means to urge said displaceable means into said extended position in sealing engagement with said canister;

means for conveying a fluid under pressure to said guide passageway when said displaceable means is in said extended position; and means for sealing said filler opening of said canister when said displaceable means is in said extended position.

22. An assembly according to claim 21 wherein said support means includes means for transferring a fusible body onto said filler opening and means for fusing said fusible body transferred onto said filler opening to close said filler opening when said displaceable means is in said extended position.

23. An assembly according to claim 22 wherein said fusible body transferring means includes means for injecting said fusible body into said guide passageway.

24. An assembly according to claim 22 wherein said fusing means includes a welding rod displaceable along said guide passageway into and out of contact with said fusible body deposited on said filler opening, and means for applying an electrical voltage to said welding rod.

25. An assembly according to claim 24 including electrically conductive means carried on said displaceable means, engageable with said canister when said displaceable means is in said extended position to provide an electrical ground for said welding rod.

26. An assembly according to claim 21 wherein said support means includes a housing having an opening therein, said opening having an enlarged section, and said displaceable means includes a first section having said guide passageway therethrough, displaceable along said housing opening, and a second section projecting into said enlarged section of said housing opening, cooperating with said housing and said first section of said displaceable means to provide a first variable volume chamber having said first side of said displaceable means forming a movable wall thereof, and a second variable volume chamber having said second side of said displaceable means forming a movable wall thereof.

27. An assembly according to claim 26 wherein said enlarged section of said housing opening includes a cylindrical side wall and opposed annular end walls, said first section of said displaceable means has a tubular configuration and said second section of said displaceable means has an annular configuration.

28. An assembly for charging a metallic canister having a filler opening therein with a gas under pressure and then sealing said filler opening to provide a closed, pressurized canister comprising:

a housing having a cylindrical bore therethrough provided with an enlarged section having a cylindrical side wall and a pair of opposed annular end walls;

a member having a tubular section providing an axial guide passageway, disposed in and displaceable along said housing bore between an extended position in sealing engagement with said canister, with said guide passageway thereof communicating with said filler opening of said canister, and a retracted position out of engagement with said canister, and an annular section received in and cooperable with the walls of said enlarged section and a portion of said tubular section to provide first and second variable volume chambers;

said housing having a first fluid passageway communicating with said first variable volume chamber and communicable with a source of fluid under pressure, a second fluid passageway communicating with said second variable volume chamber and communicable with a source of fluid under pressure, and a third fluid passageway communicating with said housing bore and communicable with a source of fluid under pressure;

said displaceable member having an access opening therein intercommunicating said third fluid passageway of said housing with said guide passageway thereof when said displaceable member is in said extended position;

means for feeding a fusible body into said guide passageway when said displaceable member is in said extended position to deposit said body on said canister across said filler opening therein; and a welding rod disposed in said guide passageway displaceable between an extended position in contact with a fusible body deposited on said canister across said filler opening therein for fusing said body and thereby closing said filler opening, and a retracted position out of contact therewith.

29. An assembly according to claim 27 wherein said housing includes a passageway communicable with said housing bore through which said fusible body may be fed into said guide passageway, and wherein said displaceable member includes an access opening communicating with said guide passageway therein and communicable with said feed passageway when said displaceable member is in said extended position.

30. An assembly according to claim 27 wherein said housing includes a passageway communicable with said housing bore through which said fusible body may be fed into said guide passageway, and wherein said displaceable member includes an access opening intercommunicating each of said third fluid passageway and said fusible body feed passageway with said guide passageway when said displaceable member is in said extended position.

31. An assembly according to claim 27 wherein said housing includes electrically conductive means engageable in electrical contact with said canister when said displaceable member is in said extended position to provide an electrical ground for said welding rod.

32. A method of charging a metallic canister having a filler opening therein with a gas under pressure and then sealing said filler opening to provide a closed, pressurized canister comprising:

applying the force of a gas under a first pressure in a first direction to a displaceable member having a guide passageway therein to displace said displaceable member into sealing engagement with said canister, with said guide passageway therein communicating with said filler opening in said canister;

injecting a gas under a second pressure through said guide passageway and said filler opening to pressurize said canister at a predetermined pressure while continuing to apply said force to maintain said displaceable member in sealing engagement with said canister;

feeding a fusible body through said guide passageway onto said canister, across said filler opening therein while continuing to apply said force to maintain said displaceable member in sealing engagement with said canister;

extending a welding rod through said guide passageway to engage and fuse said fusible body causing it to form a closure of said filler opening while continuing to apply said force to maintain said displaceable member in sealing engagement with said canister;

discontinuing the injection of said gas under said second pressure through said guide passageway;

retracting said welding rod to a retracted position;

removing said force of said gas under said first pressure; and applying the force of a gas under a third pressure in a direction opposite said first direction to said displaceable member to displace said displaceable member into a retracted position.

33. A met hod according to claim 32 wherein said first pressure is a selected pressure sufficient to provide a seal between said displaceable member and said canister.

34. A method according to claim 32 wherein said first pressure is in the range of 2,000 to 5,000 psi.

35. A method according to claim 32 wherein said second pressure is a s elected pressure corresponding to the desired pressurization of said canister.

36. A method according to claim 32 wherein said second pressure is in the range of 3,500 to 10,500 psi.

37. A method according to claim 32 wherein said third pressure is in selected pressure sufficient to retract said displaceable member into a retracted position out of engagement with said canister.

38. A method according to claim 32 including injecting a gas under a pressure greater than said second pressure through said guide passageway and said filler opening to pressurize said canister at said greater pressure for testing the structural integrity of said canister, and then reducing said pressure to said second pressure.

39. A method according to claim 38 including holding the pressurization of said canister at said greater pressure for a predetermined period of time.

40. A method according to claim 38 wherein said pressures are in the range of 3,500 to 10,500 psi.

41. A method of charging a metallic canister having a filler opening therein with a gas under pressure and then sealing said filler opening to provide a closed, pressurized canister comprising:

applying a gas under a first pressure to a first side of a displaceable member having a guide passageway therein to displace said displaceable member into a sealing engagement with said canister, with said guide passageway communicating with said filler opening in said canister;

applying a gas under a second pressure to a second side of said displaceable member, to provide a pressure differential and a resultant force acting on said displaceable means in urging it into sealing engagement with said canister;

injecting a gas under a third pressure through said guide passageway and said filler opening to pressurize said canister to a predetermined pressure while continuing to apply said force to maintain said displaceable member in sealing engagement with said canister; and sealing said filler opening in said canister while continuing to apply said force to maintain said displaceable member in sealing engagement with said canister.

42. A method according to claim 40 including varying said first and second pressure to vary the resultant force applied to said displaceable member urging it in sealing engagement with said canister.

* * * * *

UNITED STATES PATENT AND TRADEMARK OFFICE

CERTIFICATE OF CORRECTION

PATENT NO. : 5,791,122

DATED : June 17, 1996

INVENTOR(S) : Brian P. Tobin, et al

It is certified that error appears in the above-identified patent and that said Letters Patent is hereby corrected as shown below:

In the Claims:

Claims 29, 30 and 31 should read --claim 28 --.

Signed and Sealed this

Tenth Day of November 1998

Bruce Lehman

*Attest:*

BRUCE LEHMAN

*Attesting Officer*

*Commissioner of Patents and Trademarks*